United States Patent [19]

Sabins

[11] 4,191,625

[45] Mar. 4, 1980

[54] ALUMINUM MARINE ANODE ASSEMBLY WITH LOW RESISTANCE SURFACE MOUNTINGS

[75] Inventor: Rolland C. Sabins, Lakeside, Calif.

[73] Assignee: Sabins Industries, Inc., San Luis Rey, Calif.

[21] Appl. No.: 17,051

[22] Filed: Mar. 2, 1979

Related U.S. Application Data

[63] Continuation-in-part of Ser. No. 707,675, Jul. 22, 1976, and Ser. No. 512,108, Oct. 4, 1974, abandoned, said Ser. No. 707,675, is a continuation-in-part of Ser. No. 512,108, , abandoned.

[51] Int. Cl.[2] ..... C23F 13/00

[52] U.S. Cl. ..... 204/197

[58] Field of Search ..... 204/148, 197

[56] References Cited

U.S. PATENT DOCUMENTS

| | | | |
|---|---|---|---|
| 2,619,455 | 11/1952 | Harris et al. | 204/197 |
| 2,779,729 | 1/1957 | Jorgensen | 204/197 |
| 2,910,421 | 10/1959 | Sabins | 204/197 |
| 2,934,485 | 4/1960 | Sabins | 204/197 |
| 3,048,535 | 8/1962 | Sabins | 204/197 |
| 3,227,644 | 1/1966 | Rutemiller | 204/197 |
| 3,232,857 | 2/1966 | Caldwell | 204/197 |
| 3,553,094 | 1/1971 | Scott et al. | 204/197 |
| 3,870,615 | 3/1975 | Wilson et al. | 204/197 |

*Primary Examiner*—G. L. Kaplan
*Attorney, Agent, or Firm*—Trask & Britt

[57] ABSTRACT

An aluminum marine anode assembly is constructed by casting a mass of marine aluminum alloy as an anode with a partially exposed core of activator material in place. The anode is configurated to provide good conductive contact between the aluminum alloy and the activator. Copper and alloys of copper are the preferred core materials. Aluminum alloyed with zinc and tin is the preferred anode material. The anode assembly is attached to a ferrous hull by means of special low resistance surface mountings.

8 Claims, 7 Drawing Figures

ALUMINUM MARINE ANODE ASSEMBLY WITH LOW RESISTANCE SURFACE MOUNTINGS

RELATED PATENT APPLICATIONS

This application in a continuation-in-part of U.S. patent applications Ser. Nos. 707,675, filed July 22, 1976 and 512,108, filed Oct. 4, 1974 (now abandoned). The earlier parent application discloses and claims a high purity zinc anode with copper or other activator material, preferably contained as the core of the anode. The later filed parent application, which is a continuation-in-part of Ser. No. 512,108, and the present application disclose a similar anode utilizing marine aluminum alloys as the anode material. The present application also discloses an ideal anode configuration which has application with activated marine anodes generally and a preferred low resistance surface mounting assembly.

BACKGROUND OF THE INVENTION

Field

This invention pertains to the cathodic protection of metallic surfaces. It is specifically directed to such systems including marine aluminum alloy anodes directly coupled to the structure. It provides a new assembly of components, which may be embodied in an anode structure, whereby the surface of the anode is maintained sacrificial. It further provides a surface mounting assembly which assures an excellent conduction path between the anode assembly and the protected metal surface.

State of the Art

Corrosion of metallic structures exposed to either a marine or soil environment has been a notable problem in the arts utilizing such structures. A great deal of research has been conducted in the public and private sectors involving the cathodic protection of various structures, for example, ship hulls and underground pipes. Various types of impressed current systems have been employed with considerable success, but they have the attendant disadvantage of high construction, installation and maintenance costs. Impressed current systems, while theoretically ideal for the protection of hulls, have not performed satisfactorily in service because of their delicate nature and somewhat sophisticated maintenance requirements. Direct-coupled sacrificial anodes offer the advantages of low cost for construction and installation as well as relative low maintenance. Such anodes as have heretofore been available for marine applications, are characteristically effective for a time, but tend soon to develop passive coatings which alter their surface potentials. The United States Bureau of Ships has developed a direct-coupled zinc anode of high purity zinc metal, known as Military Specification MIL-A-18001 which is presently regarded as the best available. Even this high purity anode, when directly coupled to a steel ship, tends to develop inert coatings on its surfaces after only a few weeks of exposure to sea water. The surface potential of the zinc is thereby lowered so that the anode becomes ineffective in protecting a ship's hull from corrosion. It is estimated that currently, sacrificial zinc anodes of one type or another are used in connection with in excess of 90 percent of the world's shipping. Sacrificial marine anodes of marine aluminum alloy are also commercially available.

Illustrative of the art generally dealing with sacrificial anodes, and in some cases zinc anodes in association with metal structures, are U.S. Pat. Nos. 3,870,615 (Wilson); 3,726,779 (Morgan); 3,485,741 (Booker); 3,425,925 (Fleischman); 1,984,899 (Smith); 3,048,535 (Sabins); 2,619,455 (Harris et al); 3,260,661 (Kemp et al); 3,047,478 (Marsh et al); 3,772,179 (Beer); 3,567,676 (Herrigel et al); and 2,779,729 (Jorgensen); and British Patents Nos. 11,216 (Morrison); 3205 (Casperson); and 852,154. A galvanic anode constructed of marine aluminum alloy is disclosed by U.S. Pat. No. 3,227,644 (Rutemiller).

SUMMARY OF THE INVENTION

The present invention provides both a novel assemblage, preferably embodied as an anode assembly, and a system which utilizes the anode assembly (or its equivalent) to prevent the formation of an inhibitive coating on the surface of the anode. Although the invention is applicable generally to metallic structures exposed to corrosive electrolytic environments, whether underground, in contact with soil electrolytes, or in marine environments, it will be described herein with particular reference to ferrous—e.g., iron or steel-hulled ships in sea water. It is in the marine environment that the anodes and mounting structures of this invention offer the most striking advantages over presently available sacrificial anodes.

In general, the preferred anode assembly of this invention comprises a mass of sacrificial marine aluminum alloy metal, (for example, the aluminum alloys marketed by Reynolds Metal Company, American Smelting and Refining Company, Aluminum Company of America and Kaiser Magnesium Company for use in sacrificial marine anodes), in both physical and electrical contact with a suitable activator material. As used herein, the term "anode" is applied to the sacrificial portion of the anode assembly; i.e., the mass of marine alloy itself, not including the activator or other structural components of the anode assembly. In most embodiments, the activator material is selected with regard to both its electrical and physical properties. Ideally, the activator is sufficiently rigid and strong to be worked into the forms required for an element of the structural mounting of the anode to the ship's hull. Moreover, it has been determined that for use with steel hulls, the surface potential of the activator should be no more negative than −400 millivolts with respect to a silver-silver chloride half cell.

It has become conventional practice in the cathodic protection art, particularly as applied to the protection of steel hulls, to measure surface potentials of materials with respect to a silver-silver chloride half cell standard. On this basis, the surface potential of zinc of high purity is measured at approximately −1,030 millivolts and the surface of the steel is approximately −630 millivolts. The potential difference between zinc and steel or iron is thus only approximately 400 millivolts which is known to be inadequate to avoid the inhibitive process inherent with even high purity zinc. Experience has shown that maintaining a potential difference of 750 millivolts or higher between the zinc and another metal forming a couple with zinc provides sufficient electrical potential to cause the surrounding zinc surfaces to continue to go into solution. By maintaining the solution process active, new atoms of zinc metal are constantly exposed to the electrolyte. There results a certain attritional loss of the anode material, but this loss is relatively minor due to the greater attritional loss to the other metal in the couple.

Similarly, the surface potential of certain special aluminum alloys falls within the range of −1,000 millivolts and −1,300 millivolts with respect to a silver-silver chloride half cell. Such alloys are classified as marine alloys when they also exhibit the chemical and physical properties desired for use in marine environments. These alloys offer a potential difference with respect to a steel or iron hull comparable to that available with high purity zinc, and experience an inhibiting process similar to that of zinc. The use of an activating couple is thus useful with the marine aluminum alloys to maintain the sacrificial solution process active. It has been found, however, that the yield, (which may be defined as the number of ampere hours of cathodic protection available in each pound of anode material consumed) of these aluminum alloys is substantially greater than is high purity zinc. The following table lists pertinent information concerning several marine aluminum alloys available fom the Kaiser Aluminum Company, Oakland, Calif.

| ALLOY DESIG-NATION | ALLOYING METALS | POTENTIAL WITH RESPECT TO AG/AGCL HALF CELL | YIELD Ampere hours/lb |
|---|---|---|---|
| KA-95 | Hg | 1050 | 1,250 |
| KA-46 | Zn,Sn | 1080 | 1,000 |
| KA-90 | Zn,Sn | 1030 | 1,230 |
| KA-804 | Sn,(Unknown) | | |

The presence of mercury is regarded as undesirable in marine applications. The marine alloys of aluminum with zinc and tin are thus the preferred materials for use in accordance with this invention. The KA-804 alloy offers no special advantage over high purity zinc and exhibits a similar yield. Alloys similar to KA-90 are regarded as ideal for outside ship bottoms with painted surfaces, largely because higher surface potentials tend to cause strippage of paint from painted surfaces. For deep tanks, drilling rigs and unpainted areas, where paint stripping is not a consideration, alloys similar to KA-46 are generally preferred. The aluminum alloys disclosed by U.S. Pat. No. 3,227,644 which have surface potentials within the range of −1000 and −1300 millivolts with respect to an Ag/AgCl half cell are also useful as marine aluminum alloys.

Activator materials suitable for use with the anodes of this invention should have a potential difference between their surface potential and that of the anode at least 200 millivolts greater than the corresponding potential difference between the anode and the structure to be protected. When the structure is of steel, suitable activators are generally those which are no more negative on the aforementioned scale than −400 millivolts. Prefereably, the activator should be substantially less negative, more on the order of −300 millivolts or less, to achieve the 750 millivolt potential difference observed to be the magnitude of the operating potential difference required to insure continuous attrition of the aluminum alloy surface. Certain copper-tin alloys (e.g., bronzes) can be utilized, although they exhibit a potential difference with respect to aluminum of only approximately 700 millivolts. Accordingly, the activation provided by their use is "borderline" from the standpoint of this invention. Nevertheless, even this level of activation is very helpful in inhibiting or delaying the deposition of an inactive surface on the anode. A potential difference of less than 600 millivolts is generally unsatisfactory. From most standpoints, copper is an ideal material, exhibiting approximately −220 millivolts of surface potential, although many other materials could be used were it not for their expense or undesirable physical properties. For example, monel, silver and platinum are all operable, but impractical because of cost.

The presently preferred activator material for use with this invention is copper because of its good mechanical properties and its adequate surface potential. A "red bronze" alloy of copper, containing on a weight basis, about 3 percent zinc, 6½ percent tin and 1½ percent lead, is presently regarded as an ideal activator material. Monel, while operable, is generally too expensive. Either carbon or lead activators may be employed. Less exposed surface is required for such activators than when copper is used. Moreover, in each instance, these materials tend to drive electrons from the surface of aluminum to an extent which causes unduly rapid activator-induced attrition from the anode surface. By "activator-induced attrition" is meant weight loss of anode metal in excess of the galvanic metal loss attributable to protection of the ship's hull. Sacrificial metal loss due to the galvanic couple of an anode and the ship's hull varies considerably, depending upon factors such as ship speed, temperature and salinity of the water, composition of the anode, etc., but in any event is distinguishable from the attrition of anode metal due solely to the activator itself. While some activator-induced attrition is desirable to maintain the anode sacrificial in its galvanic couple with the ship, the ratio of exposed surface areas of activator to anode metal, respectively, is desirably selected to maintain the annual activator-induced attrition rate (weight loss) of the anode to below about 10 percent, preferably between about 1 percent and 5 percent.

A typical anode of this invention is expected to be in service for two years. Initially the activator-induced attrition rate will be lower, usually about 1 to 3 percent. By the end of its service life, the activator-induced attrition rate will normally have increased to as high as about 5 to 10 percent due to the changing surface ratios of anode to activator as attrition proceeds. The activators and anodes can be shaped to counteract this tendency, but normally the increased attrition rate is desirable to balance the inherent increased tendency of the anode surface to become passive (probably because of concentrating impurities). Hence, the anode configuration shown in the drawings is highly preferred. The ratio of exposed surface areas of activator to anode alloy, respectively, is desirably selected to maintain the attrition rate of the anode to below about 10 percent, preferably between about 1 percent and 5 percent.

The mode of operation of this invention may be explained as follows, although the specific mechanism involved is of no consequence except as an assistance in calculating the amount of surface area of anode required to suitably protect a particular structure in a particular environment. Assuming an array of KA-90 marine aluminum anodes with copper activator structures cast in place with exposed surfaces, the copper is in intimate physical and electrical contact with both the KA-90 alloy and the sea water environment. The potential difference between the KA-90 alloy and the copper surfaces is approximately 810 millivolts, which tends to drive electrons from the surface of the alloy to the surface of the copper. Ultimately, the two surfaces would tend to equalize in potential, except that the surface potential of the copper activator becomes so negative with respect to its normal surface potential that electrons are emitted to the sea water. As a consequence, a continuous flow of electrons from the alloy surface to the copper is maintained. In this fashion, new metal atoms from the alloy are continuously exposed, maintaining the active surface potential of the KA-90 alloy at approximately −1,030 millivolts. Concurrently, electrons are migrating to the ship's hull, providing additional loading on the anodes. But for the copper activator surfaces, the surface potential of the hull adjacent the anode would ultimately approximate that of the KA-90 alloy, thereby inhibiting the activity of the anode surface rather than activating it.

Generally, when copper is used as the activator surface, each standard KA-90 alloy anode (containing approximately 19 pounds of KA-90 alloy) used in sea water in a galvanic direct couple to a steel or iron hull will protect approximately 500 square feet of wetted surface and will deliver a minimum of approximately 23,000 ampere hours of protective current per year (approximately 5 milliamps per square foot). Under these conditions, each anode will sacrifice, through attrition from its surface, an average of about 0.06 lbs. of alloy metal annually. A typical standard anode has a surface area of approximately 1¾ square feet, so that under the aforedescribed conditions, the ratio of anode surface to hull surface is approximately 1 to 300.

A special mounting assembly is provided in accordance with this invention whereby anodes may conveniently be exchanged without welding. Thus, anodes may be replaced by divers without dry docking the ship if desired. The mounting is structured so as to maintain positive physical and electrical coupling between the aluminum alloy anode material through a continuous mass of metal structure, including the activator core material, to the ship's hull. Ideally, the anodes are formed as cylindrical bars cast around cylindrical cores and are of standardized lengths to facilitate interchangeability. It has been found that attrition of such anodes in use tends to proceed primarily from the ends toward the middle.

BRIEF DESCRIPTION OF THE DRAWINGS

In the drawings which illustrate what is presently regarded as the best mode for carrying out the invention.

DESCRIPTION OF THE ILLUSTRATED EMBODIMENT

Figure 2:
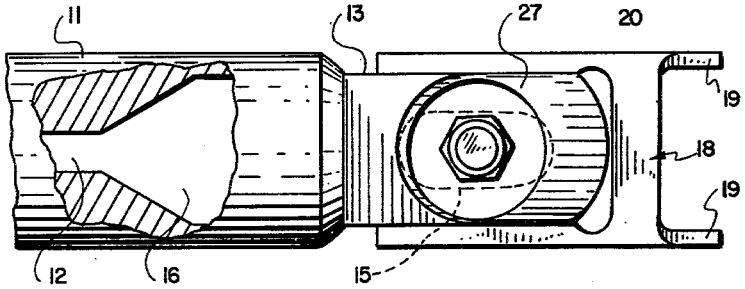
FIG. 2 is a view of the assemblies shown by FIG. 1 rotated 90° and in fully assembled condition, with a portion of the anode assembly in section to show a copper core cast in place within the anode.
Figure 3:
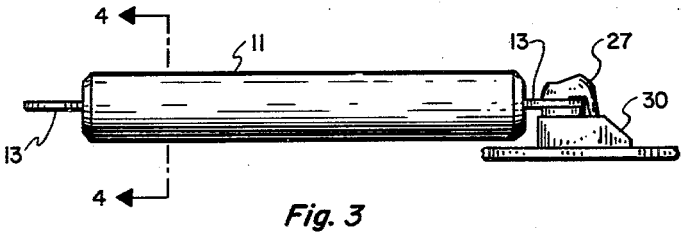
FIG. 3 is a view in side elevation of an anode assembly fixed at one end to a mounting assembly.
Figure 6:
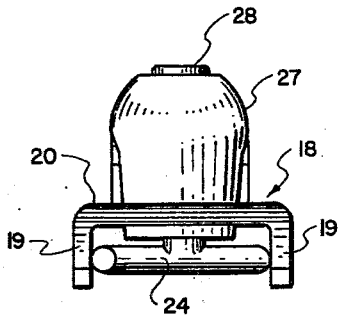
FIG. 6 is an end view of an assembled mounting assembly as shown by FIG. 3.

The marine anode illustrated by FIGS. 1 through 4 comprises a mass 11 of marine aluminum alloy metal, preferably KA-90 alloy, cast around a copper rod core 12, embedded in the mass of alloy as best seen from FIGS. 2 and 4. End portions 13 of the core 12 extend as mounting lugs, each of which is provided with a hole 15 (FIG. 2) adapted to register with appropriate pins or bolts of mountings fastened to the hull of a ship or other structure it is desired to cathodically protect. The exposed surfaces of the lugs 13 provide an initial activating surface which normally suffices, without more, to retain the aluminum alloy anode mass 11 sacrificial. As attrition of the alloy 11 proceeds, the surface area of the lugs is inevitably supplemented by the exposure of increasing portions of the activator core 12.

The anode metal mass 11 may be formed in various shapes, but preferably takes the cylindrical anode shape shown. This shape has been found advantageous for core-activated anodes generally, whether of the zinc type claimed in the aforementioned patent application Ser. No. 512,108, the disclosure of which is incorporated by reference herein, or the marine aluminum alloy type disclosed herein and in parent application Ser. No. 707,675, the disclosure of which is also incorporated by reference. As shown by FIG. 2, each anode has somewhat enlarged end portions 16 extending a few (in the illustrated instance, about 3) inches in length, and generally about 2½ to about 3 inches at their widest transverse dimensions.

Figure 4A:
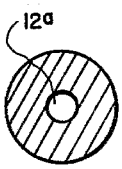
FIG. 4 includes two alternative views in section taken along the section line 4—4 of FIG. 3 viewed in the direction of the arrows, FIG. 4*a* showing a core having a round cross-section and FIG. 4*b* showing a core having a square cross-section.
Figure 4B:
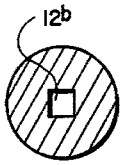

The remaining length of the anode mass 11, usually about 20 inches to about two feet (in the illustrated instance, 22½ inches), may be of circular cross-section as shown by FIG. 4*a*. A rectininear cross-section, such as shown by FIG. 4*b*, is sometimes preferred. The enlarge ends 16 accommodate the flattened extensions 13 of the core 12. As illustrated by FIG. 4*a*, the core 12 is a copper rod about ⅝ inch in diameter, and the annular alloy anode 11 has an outer diameter of about 2 5/16 inches. This construction provides an initial exposed surface ratio of anode to core of about 8:1. As attrition proceeds under use conditions, this ratio decreases until it ultimately approaches 1:1. In practice, the initial ratio of exposed surfaces may be selected within the range of about 5:1 to about 15:1, although the most useful initial ratio when copper cores are utilized appears to fall within the range of about 7:1 to about 10:1.

Anodes of the type illustrated may be standardized to be readily replaced on standardized mountings. A representative standard fresh anode of this type would include approximately 250 square inches exposed anode surface, approximately 19 lbs. of KA-90 marine aluminum alloy metal, approximately 22½ square inches of exposed activator surface, and approximately 4½ lbs. of copper core material.

The copper cores 12 provide all of the activator surface requireed by the anode and cathodic protection systems of this invention. It is to be understood that other materials such as lead or carbon might be substituted for the copper cores illustrated, although steps would then need to be taken to reduce the exposed surface area of these materials as well as to provide for rigidity and suitable structural properties of the overall assembly. It is particularly desirable that the copper cores be mounted in such a manner that there is electrical continuity by direct coupling between the mounting lugs 13 and the steel hull.

As used herein and in the claims, the term "direct coupling" refers to physical contact between two metallic surfaces sufficient to provide excellent electrical conduction across a substantial surface area of the two materials, as opposed to through a wire or cable conductor interconnecting the two materials. Such coupling may be through intermediate metallic surfaces, such as those inherent in the mounting assembly of this invention.

It is essential that the surface mounting assembly of this invention provide a low resistance current path capable of passing the current required for cathodic protection. The amount of current required in any given instance is determined by many factors, such as the ratio of anode to hull surface area, the composition and temperature of the sea water, ship speed, etc. In any event, if the surface mounting passes inadequate current, the anodes cannot drive the potential of the ship's hull to its protective level. Thus, the mounting must pass sufficient current to maintain the potential of the hull (measured with respect to an Ag/AgCl half cell) no less negative than about −585 mV, preferably more negative than −630 mV and ideally more negative than about −900 mV.

Figure 1:
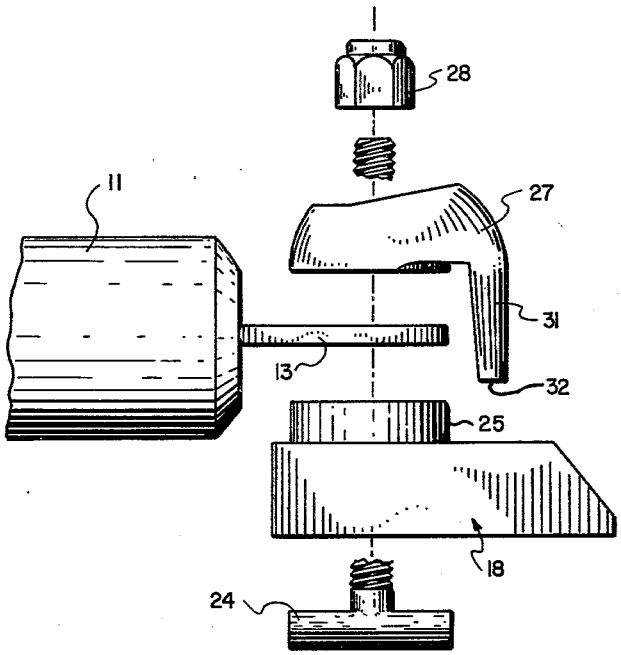
FIG. 1 is an exploded view of a mounting assembly of this invention showing the components of the mounting assembly in association with an anode assembly of this invention.
Figure 5:
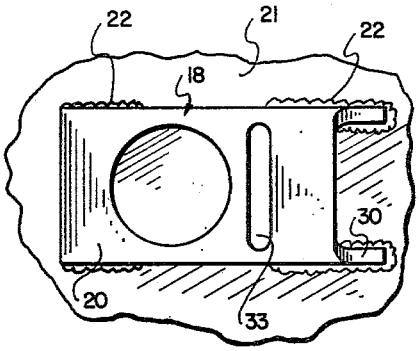
FIG. 5 is a fragmentary plan view of a ship hull with a portion of the mounting assembly of FIG. 1 welded in place.

A highly preferred mounting assembly is illustrated by the drawings. A steel foundation base 18, in the form of a bracket with opposed sides 19 and a slotted top 20, is adapted for welding directly to a ship's hull 21, as shown by FIG. 5. It is important that sufficient weld 22 be used to ensure a low resistance current path between the anode 11 and the hull 21. Consistently good results have been obtained by providing at least 20 inches of welded interface 22 for each base 18. A tee bolt 24, preferably of forged steel, is received between the sides 19 of the base 18 and extends up through the slotted top 20 and through the hole 15 in the anode mounting lug 13. A tee bolt is used to avoid the use of either a threaded or a welded connection with the foundation base 18, either of which would be susceptible to corrosion. The lug 13 rests atop a conductive pad 25. The pad may be integral with the base 18, or it may be a copper, brass or bronze washer, silver soldered or oven brazed to the base 18. Brass is preferred because it is maleable than the other materials, and is easier to solder or braze to the steel base 18. The pad 25 is adapted to provide a low resistance current path at its interface with the lug 13. A suitable current path is ensured by providing substantial surface contact between the pad and the lug, and by providing a high quality soldered or brazed connection of the pad to the base. A specially configurated top washer 27, preferably of brass or bronze, (although any inert material of good strength could be used), slips over the threaded end of the tee bolt, and a nut 28 presses the assembly together to assure direct physical coupling between the lug 13, the pad 25, the base 18 and the hull 21. To exchange anodes, it is merely necessary to remove the nut 28, slip off the top washer 27 and lift the anode assembly from the mountings. A new anode assembly is placed over the tee bolt 24, and is pressed to the base 18 by replacing the top washer 27 and nut 28. The nut 28 is ideally of steel with a plastic flex lock insert. No welding or other elaborate dry dock procedures are required.

An outstanding feature of the mounting structure of this invention is its streamlined configuration. This configuration avoids much of the fouling experienced by trawlers and others who find it necessary to pass lines and cables across the hull regions carrying anodes. The base 18 preferably includes a ramped edge 30 oriented away from the anode 11 location to wedge (lift) lines, etc. which may be dragged into the assembly up and over the anode 11. The leading edge 31 of a depending leg 32 integral with the top washer 27 registers with a slot 33 in the top 20 of the base 18, thereby continuing the streamlined surface of the ramp 30. The top washer 27 rises to near or above the upper surface of an anode held by the mounting structures. Accordingly, lines or cables may pass the anodes almost unimpeded.

As is well known in the art pertaining to cathodic protection of metallic structures in a marine environment, even the high purity Military Specification zinc anodes preferred by the art will at some point during their first several months in sea water develop a surface coating which actually inhibits or lowers the surface potential of the zinc to lower in the galvanic series than the surrounding ship surfaces. At that time, the zinc no longer serves or functions as an anode to the ship but becomes cathodic with respect to the ship, thereby causing the ship to function as an anode in the region around the zinc anode. Inspection of zinc anodes during annual docking of ships has revealed a measured surface potential as low as −300 or −400 millivolts with respect to a silver-silver chloride half cell compared to the normal potential of −1,030 millivolts. A similar phenomenon occurs when marine aluminum alloy anodes are used in place of zinc anodes. Use of the activating cores taught by this invention in the cathodic protection system provides sufficient voltage differential between the alloy and the bus bars to destroy the resistive or inhibiting coatings normally developed by the anode in use.

The anode assemblies of this invention are best embodied as an array arranged in number and location to provide cathodic protection to a steel or iron ship's hull. The number of anodes required in a given array depends on several factors, including the wetted surface area of the hull. This area is typically determined by a rigorous formula related to the type of hull involved. For example, the wetted surface area of a well streamlined hull, such as a C-4 cargo ship, is regarded as the sum of sixty percent of the product of the length and beam dimensions plus a factor of 1.7 times the product of the length and depth dimensions (i.e., $L \times D \times 1.7 + L \times B \times 0.6 =$ wetted surface). Similar formulas have been worked out for various shapes of hulls. Given the wetted surface area the number and placement of anodes in the array may be determined.

Desirably, each of the anodes of this invention is associated with between about 100 and about 1300 square feet of wetted surface area, giving an initial anode-to-hull surface area ratio of between about 1:50 and about 1:750.

In summary, this invention provides a cathodic protection system for the hulls of ocean-going ships. The system includes an array of sets of the anode assemblies described herein, each in association with a spaced pair of the mounting assemblies described herein. Each of the surface mounting assemblies includes a base, usually steel, welded directly to the ferrous hull. The base includes spaced, upstanding sides welded at one edge to the hull, and connected at their distal ends to a top plate. A tee bolt is installed with its head between the upstanding sides, and with a threaded shaft extending up through the top plate. Clamping means (such as the top washer and nut described herein) are provided in association with the tee bolt and are cooperatively adapted therewith to connect with the core of an anode in a low resistance electrical connection. The core is ideally of copper or copper alloy, and the anode itself is ideally of an aluminum alloy metal having a surface potential of between about −1000 mV and about −1300 mV with respect to a silver/silver chloride half cell. The mountings should be "streamlined"; that is, they should be configured to avoid entanglement with lines of various types dragged across the hull.

Reference herein to details of the illustrated embodiments should not be taken as limiting the scope of the appended claims, which themselves recite those features regarded as essential to the claimed invention.

I claim:

1. Mounting structure for marine anodes, comprising:
   - a metallic base welded to a ship's hull with sufficient weld material to provide a low resistance current path through said base to said hull, including spaced, upstanding sides and a top;
   - a tee bolt between said upstanding sides with a threaded shank extending up through said top;
   - a conductive mounting pad associated with said top and adapted to provide a low resistance current path into said top surounding said threaded shank, constituting means for direct physical coupling to a mounting lug of a marine anode;
   - top washer means cooperatively adapted with said mounting pad to clamp said mounting lug therebetween; and
   - means for pressing said top washer down towards said mounting pad, thereby ensuring a low resistance current path from an anode associated with said mounting lug through said mounting pad and base to said hull.

2. Mounting structure according to claim 1 wherein said metallic base is of steel and is welded to said ship's hull with at least about twenty inches of welded interface.

3. Mounting structure according to claim 1 wherein said base includes a ramped leading edge oriented away from the anode location.

4. Mounting structure according to claim 3 wherein said top washer means includes a depending leg with a streamlined leading edge extending upward from the top of said base.

5. Mounting structure according to claim 1 wherein said conductive mounting pad is of brass, silver soldered to the base.

6. A cathodic protection system for the hull of a ship, including an array of sets of sacrificial anode assemblies mounted on the exterior surface of said hull by surface mounting assemblies, each said set including:
   - a pair of surface mounting assemblies spaced from each other to receive an anode therebetween, each said mounting assembly including:
     - a steel base with spaced upstanding sides welded to said hull, and a top plate connecting the distal ends of said sides,
     - a tee bolt between said upstanding sides with a threaded shaft extending up through said top plate, and
     - clamping means cooperatively adapted with said tee bolt; and
   - an anode assembly including:
     - a sacrificial anode of aluminum alloy metal with a surface potential measured with respect to a silver/silver chloride half cell of between about −1000 mV and about −1300 mV, in intimate surface contact with:
     - a copper or copper alloy metal core cast in place within said core extending from said anode with opposite ends of said anode configured for connection to respective said surface mounting assemblies; said ends of said core being:
   - clamped to said surface mounting assemblies to provide a low resistance current path from said anode, through said surface mountings to said hull.

7. A cathodic protection system according to claim 6 wherein each base plate is welded to said hull by at least about twenty inches of welded interface.

8. A cathodic protection system according to claim 7 wherein each surface mounting base includes a ramped leading edge oriented away from the anode and the clamping means is adapted to continue a streamlined surface from the top of the base plate to at least near the top surface of said anode.

* * * * *